United States Patent [19]

Escalante

[11] Patent Number: 4,972,964

[45] Date of Patent: Nov. 27, 1990

[54] BOTTLE HOLDER

[76] Inventor: Frank A. Escalante, 7060 Jackson Dr., San Diego, Calif. 92119

[21] Appl. No.: 422,663

[22] Filed: Oct. 17, 1989

[51] Int. Cl.[5] ..... A47I 45/00

[52] U.S. Cl. ..... 220/94 R; 220/94 A; 220/85 H; 215/100 A; D7/622

[58] Field of Search ..... 220/94 A, 94 R, 85 H; 215/100 A

[56] References Cited

U.S. PATENT DOCUMENTS

| | | | |
|---|---|---|---|
| 3,056,622 | 10/1962 | Hilderbrandt et al. | 220/94 R |
| 4,486,043 | 12/1984 | Rais | 220/94 A |
| 4,552,396 | 11/1985 | Rais | 220/94 A |
| 4,627,546 | 12/1986 | Carranza | 220/94 A |
| 4,666,197 | 5/1987 | Watson et al. | 210/100 A |
| 4,724,971 | 2/1988 | Henline | 220/94 R |
| 4,741,073 | 5/1988 | Capen | 220/85 H |
| 4,817,810 | 4/1989 | Shull | 220/94 R |

*Primary Examiner*—Joseph Man-Fu Moy
*Attorney, Agent, or Firm*—Robert M. Sperry

[57] ABSTRACT

An improved bottle holder comprising a lattice-like structure sized to enclose approximately the lower half of a bottle and having latching means engageable with a portion of said bottle to releasably lock the bottle in the bottle holder.

3 Claims, 2 Drawing Sheets

BOTTLE HOLDER

BACKGROUND

1. Field of Invention

This invention relates to bottle holders and is particularly directed to improved holders for plastic soft drink bottles and the like.

2. Prior Art

Bottle holders have probably been in use almost as long as there have been bottles and innumerable forms and advantages are provided by each. Recently, however, containers have been developed soft drinks and the like which are formed of relatively flexible plastic material. While these plastic bottles are very inexpensive to produce, their flexibility makes them awkward to handle. In view of this, it is desirable to provide a bottle holder for use with such plastic bottles. As noted above, innumerable forms of bottle holders have been proposed heretofore. However, most of the prior art bottle holders are intended for use with rigid bottles and are not suitable for use with flexible bottles. Furthermore, many of the plastic soft drink bottles are relatively large, frequently containing two liters of fluid. Thus, a relatively large bottle holder is required, which :s relatively expensive to produce and which is bulky and heavy to use. Alternatively, a relatively small bottle holder may be employed, provided some means is provided to prevent the bottle from falling out of the holder. No satisfactory means of accomplishing this has been proposed in the prior art.

BRIEF SUMMARY AND OBJECTS OF INVENTION

These disadvantages of prior art bottle holders are overcome with the present invention and an improved bottle holder is provided which is relatively small in size and, hence, is light in weight and easy to use, while being relatively inexpensive to produce, yet which includes means for releasably locking a bottle in the bottle holder and, thus, positively prevents the bottle form falling out of the bottle holder.

These advantages of the present invention are preferably attained by providing an improved bottle holder comprising a lattice-like structure sized to enclose approximately the lower half of a bottle and having latching means enqaqeable with a portion of said bottle to releasably lock the bottle in the bottle holder.

Accordingly, it is an object of the present invention to provide an improved bottle holder.

Another object of the present invention is to provide an improved bottle holder for flexible plastic bottles.

A further object of the present invention is to provide an improved bottle holder for flexible plastic bottles having means for releasably locking said bottle within said bottle holder.

An additional object of the present invention is to provide an improved bottle holder for flexible plastic bottles which bottle holder is light in weight, easy to use and relatively inexpensive to produce.

A specific object of the present invention is to provide an improved bottle holder comprising a lattice-like structure sized to enclose approximately the lower half of a bottle and having latching means enqaqeable with a portion of said bottle to releasably lock the bottle in the bottle holder.

These and other objects and features of the present invention will be apparent from the following detailed description, taken with reference to the figures of the accompanying drawing.

DETAILED DESCRIPTION OF THE INVENTION

Figure 1:
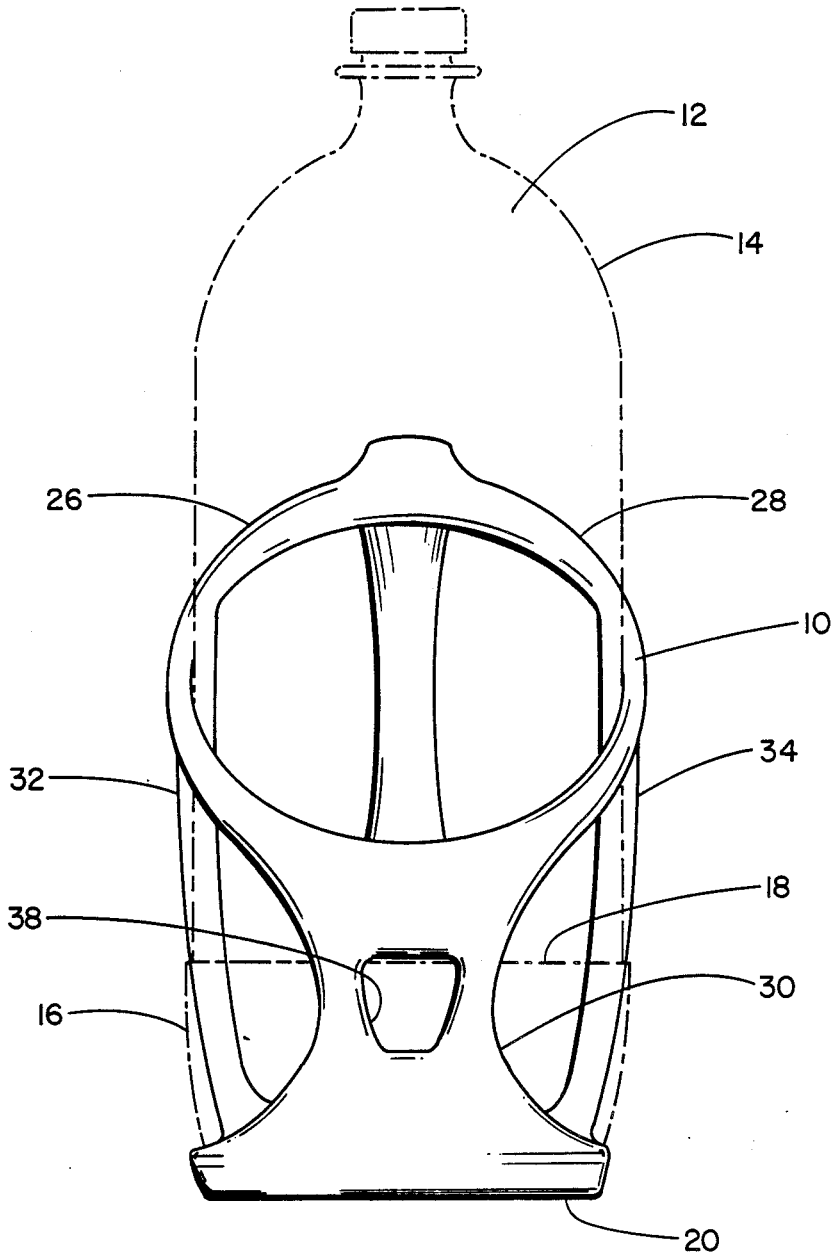
FIG. 1 is a front view of a bottle holder embodying the present invention, shown holding a flexible plastic bottle.
Figure 2:
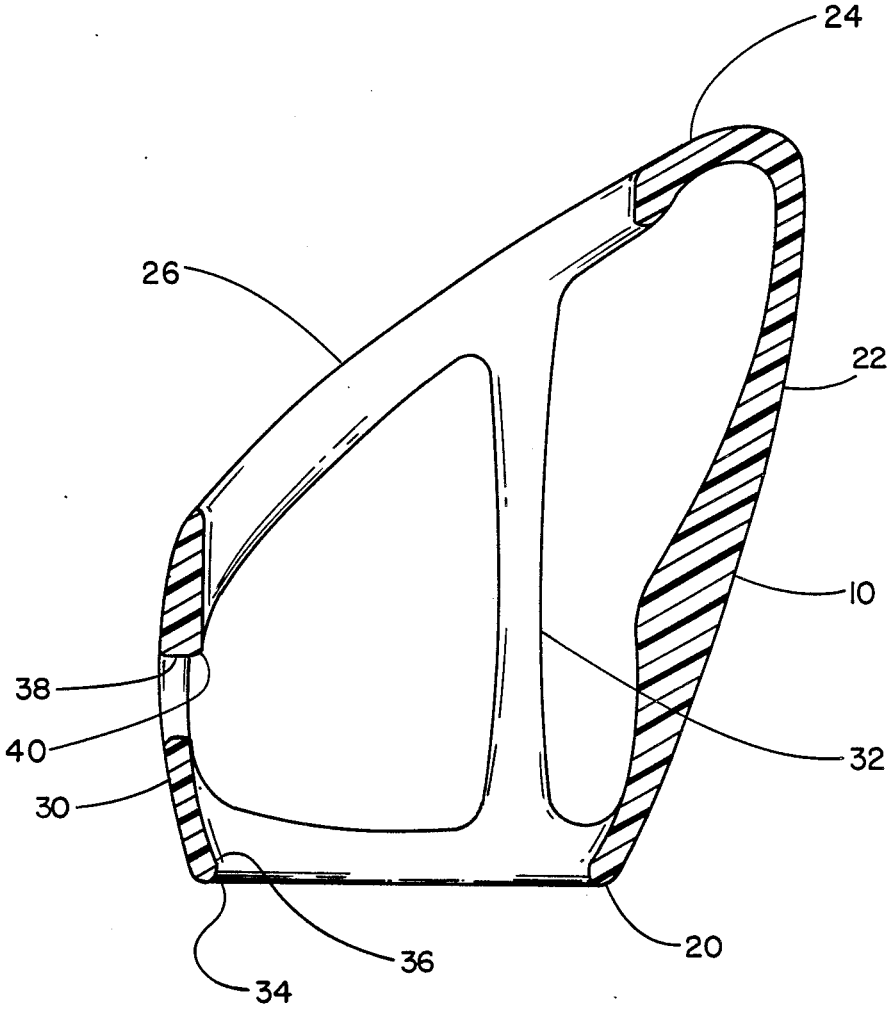
FIG. 2 is a transverse section through the bottle holder of FIG. 1 with the bottle removed.

In that form of the present invention chosen for purposes of illustration in the drawing, FIG. 1 shows a bottle holder, indicated generally at 10, containing a two liter soft drink container, indicated generally at 12, having an upper portion 14 formed of flexible plastic and having a base portion 16 formed of heavier or more rigid plastic which extends upward about the lower part of the upper portion 14 and forms a ridge 18 at the upper edge of the base portion 16 extending about the periphery of the container 12. As seen in FIGS. 1 and 2, the bottle holder 10 is preferably formed of a rigid material, such as a rigid plastic, and comprises a lattice-like structure having a generally circular base portion 20 with a handle 22 curving upwardly and outwardly and recurving at its upper end 24 where it becomes bifurcated and divides into two arms 26 and 28 which extend downwardly and forwardly to join in a front member 30 which extends downwardly to rejoin the base portion 20. In addition, a pair of side support members 32 and 34 extend downward from approximately the midpoints of the arms 26 and 28 to join the base portion 20 and provide lateral support for the container 12. As best seen in FIG. 2, the base portion 20 is preferably formed with a central opening 34 and has a flange 36 extending inward about the periphery of the opening 34 to support the base portion 16 of the container 12. Finally, the front member 30 of the bottle holder 10 has a rectangular opening 38 formed therein and the portion of the front member 30 above the opening 38 is of greater thickness than that the lower portion of the front member 38 so that the upper edge of the opening 38 forms a ledge 40 which overlies the ridge 18 at the upper edge of the base portion 16 of the container 12 when the container 12 is fully seated in the bottle holder 12 and serves to releasably lock the container 12 in the bottle holder 10.

In use, the container 12 is inserted into the bottle holder 10 until the bottom of the base portion 16 of the container 12 seats against the flange 36 in the base portion 20 of the bottle holder 12. As the container 12 is inserted into the bottle holder 10 and the ridge 18 at the upper edge of the base portion 16 of the container 12 is inserted past the ledge 40 in the front member 30 of the bottle holder 10, the contents of the container 12 will urge the walls of the base portion 16 of the container 12 outwardly, causing the ridge 18 to become releasably locked under the ledge 40 of the bottle holder 10. This securely retains the container 12 in the bottle holder 10 even if the bottle holder 10 and container 12 are fully inverted. Moreover, the handle 22 provides a convenient means for qripping the bottle holder 11 and, hence, the container 12 which does not flex and yield as the contents of the container 12 are poured out, as is often the case when the container 12 is grasped directly. When it is desired to remove the container 12 from the bottle holder 10, the user inserts a finger through the opening 38 in the front member 30 of the bottle holder 10 and presses the upper edge of the base portion 16 of the container 12 inwardly to release the ridge 18 of the container 12 from engagement with the ledge 40 of the front member 30 of the bottle holder 10. The container 12 may then be removed from the bottle holder 10 by drawing the container 12 upward out of the bottle holder 10.

Obviously, numerous variations and modifications can be made without departing from the spirit of the present invention. Therefore, it should be clearly understood that the form of the present invention described above and shown in the figures of the accompanying drawing is illustrative only and is not intended to limit the scope of the present invention.

What is claimed is:

1. A bottle holder comprising:

a lattice-like structure sized to enclose approximately only the lower half of a container, said structure comprising a base portion formed with an inwardly projecting flange for supporting the base of said container, a handle portion extending upwardly and outwardly from said base portion and recurving at the upper end thereof to form a pair of arms extending forwardly and downwardly of opposite sides and joining to form a front member extending downward to join said base portion, and latching means formed in said structure and engageable with a portion of said container to releaseably lock said container in said bottle holder.

2. The device of claim 1 further comprising:

an opening formed in said front member having a flat upper edge with the portion of said front member above said opening being thicker than the portion of said front member below the upper edge of said opening to form a ledge projecting inward from said front member.

3. The device of claim 1 wherein:

said structure is formed of rigid plastic.

* * * * *